US010612236B1

(12) United States Patent
Satterfield et al.

(10) Patent No.: US 10,612,236 B1
(45) Date of Patent: Apr. 7, 2020

(54) NON-WALKABLE CLEAN ROOM CEILING, MOUNTING SYSTEM, AND METHOD

(71) Applicant: AES Clean Technology, Inc., Suwanee, GA (US)

(72) Inventors: Louis C. Satterfield, Gwynned, PA (US); Robert G. Satterfield, Ambler, PA (US); Robert J. Bright, Sellersville, PA (US); Richard Dobson, Flowery Beach, GA (US); Glenn Vandergrift, Buckingham, PA (US)

(73) Assignee: AES Clean Technology, Inc., Suwanee, GA (US)

( * ) Notice: Subject to any disclaimer, the term of this patent is extended or adjusted under 35 U.S.C. 154(b) by 0 days.

(21) Appl. No.: 16/204,927

(22) Filed: Nov. 29, 2018

(51) Int. Cl.

| | |
|---|---|
| ***E04B 9/06*** | (2006.01) |
| ***E04B 9/28*** | (2006.01) |
| ***E04B 9/04*** | (2006.01) |
| ***E04B 9/24*** | (2006.01) |

(52) U.S. Cl.
CPC ..... *E04B 9/067* (2013.01); *E04B 9/0435* (2013.01); *E04B 9/0471* (2013.01); *E04B 9/245* (2013.01); *E04B 9/28* (2013.01)

(58) Field of Classification Search
CPC . E04B 9/28; E04B 9/245; E04B 9/067; E04B 9/0471; E04B 9/0435
See application file for complete search history.

(56) References Cited

U.S. PATENT DOCUMENTS

| | | | | | |
|---|---|---|---|---|---|
| 1,997,582 | A * | 4/1935 | Heeren | E04B 9/26 | 52/145 |
| 2,389,171 | A * | 11/1945 | Urbain | E04B 9/30 | 52/283 |
| 3,513,613 | A * | 5/1970 | Reid | E04B 9/068 | 52/222 |
| 3,782,082 | A * | 1/1974 | Smith | B01D 46/12 | 55/494 |
| 3,832,816 | A * | 9/1974 | Jahn | E04B 9/068 | 52/779 |
| 4,291,783 | A * | 9/1981 | Harris | E04B 9/0428 | 181/295 |
| 4,361,996 | A * | 12/1982 | Smith | E04B 9/064 | 52/506.07 |
| 4,444,524 | A * | 4/1984 | Cook | E04B 9/24 | 403/387 |
| 4,463,537 | A * | 8/1984 | Rodriquez | E04B 9/225 | 52/506.07 |
| 4,520,609 | A * | 6/1985 | Worley | E04B 9/067 | 52/506.07 |

(Continued)

*Primary Examiner* — James M Ference
(74) *Attorney, Agent, or Firm* — Robert J. Yarbrough of Lipton, Weinberger & Husick

(57) ABSTRACT

A ceiling system for a clean room, a clean room ceiling and a method for constructing a ceiling for a clean room are provided. Inverted T-shaped beams support the ceiling from a building structure. A bracket attaches to a composite ceiling panel and engages a beam joint portion that extends in an upward direction from a beam leg. The beam joint portion and the composite periphery of the composite ceiling panel define a relief for solvent welding of a panel joint lower end of a composite ceiling panel to a beam joint lower end. A spring clip may resist vertical movement of the bracket with respect to the inverted T-shaped beam.

16 Claims, 9 Drawing Sheets

(56) References Cited

U.S. PATENT DOCUMENTS 4,736,564 A * 4/1988 Gailey ..... E04B 9/0485 52/506.07
4,760,677 A * 8/1988 Nassof ..... E04B 9/28 52/145
5,024,034 A * 6/1991 Gailey ..... E04B 9/24 52/506.07
5,182,893 A * 2/1993 Goodworth ..... E04B 2/7409 52/745.05
5,896,724 A * 4/1999 Tofts ..... E04B 9/068 52/506.07
5,993,311 A * 11/1999 Feller ..... B01D 46/0005 454/187
6,108,994 A * 8/2000 Bodine ..... E04B 9/28 52/506.07
6,138,416 A * 10/2000 Platt ..... E04B 9/006 362/150
6,260,325 B1 * 7/2001 Wendt ..... E04B 9/068 52/489.2
6,318,042 B1 * 11/2001 Bloom ..... E04B 9/065 52/506.07
6,389,771 B1 * 5/2002 Moller ..... E04B 9/26 52/506.01
6,523,314 B1 * 2/2003 LaLonde ..... E04B 9/005 52/506.07
6,701,686 B1 * 3/2004 Platt ..... E04B 9/02 52/506.07
6,782,670 B2 * 8/2004 Wendt ..... E04B 9/0478 52/311.1
7,516,585 B2 * 4/2009 Lehane, Jr. ..... E04B 9/068 29/897.312
7,712,274 B2 * 5/2010 Wendt ..... E04B 9/003 52/377
7,765,762 B2 * 8/2010 Gulbrandsen ..... E04B 9/0414 52/506.07
8,056,294 B2 * 11/2011 LaLonde ..... E04B 9/06 52/506.09
8,096,089 B2 * 1/2012 Platt ..... E04B 9/0414 52/316
8,359,801 B2 * 1/2013 Lehane, Jr. ..... B21D 5/08 52/506.07
8,578,673 B2 * 11/2013 Kelly ..... E04B 9/122 52/220.6
8,739,488 B2 * 6/2014 Vakhnin ..... E04B 9/068 52/506.06
9,273,465 B1 * 3/2016 Bergman ..... E04B 9/225
10,113,724 B2 * 10/2018 Satterfield ..... F21V 15/013
10,151,462 B1 * 12/2018 Satterfield ..... F21V 21/048
2006/0010812 A1 * 1/2006 Jones ..... E04B 9/068 52/506.07
2006/0064939 A1 * 3/2006 Kelley ..... E04B 9/003 52/506.07
2008/0047214 A1 * 2/2008 Gerkes ..... E04B 9/0428 52/506.06
2008/0086962 A1 * 4/2008 Jahn ..... E04B 9/26 52/220.6
2008/0216431 A1 * 9/2008 McGee ..... E04B 9/02 52/506.09
2008/0229680 A1 * 9/2008 Jahn ..... E04B 9/067 52/105
2009/0000231 A1 * 1/2009 Burns ..... E04B 9/02 52/506.07
2016/0252196 A1 * 9/2016 Meister ..... E04B 9/16 248/62
2017/0362829 A1 * 12/2017 Satterfield ..... E04B 9/04

* cited by examiner

NON-WALKABLE CLEAN ROOM CEILING, MOUNTING SYSTEM, AND METHOD

I. BACKGROUND OF THE INVENTION

A. Field of the Invention

The invention is a mounting system for a non-walkable clean room ceiling, a clean room ceiling utilizing the mounting system and a method of installing a clean room ceiling utilizing the mounting system. The ceiling is non-walkable. The ceiling of the Invention approximates the appearance from inside the clean room of a more expensive walkable clean room ceiling and presents a better opportunity for cleaning and disinfection compared to a conventional non-walkable clean room ceiling.

B. Statement of the Related Art

Clean rooms are used to control the environment and prevent contamination of product, equipment, materials and processes in the pharmaceutical, biotechnology, life sciences and technology industries. A clean room may take the form of a building-within-a-building, with a clean room envelope within a larger building envelope. The larger building protects the clean room from the elements, contains mechanical systems serving the clean room and may provide structural support to the clean room. The clean room provides a discrete space in which the operator can separately control the temperature, humidity, cleanliness and air pressure.

A non-walkable clean room ceiling is not adequately robust to support adult human beings walking on the top of the non-walkable ceiling, but is adequate to segregate the clean room from the rest of the larger building. A non-walkable clean room ceiling may require catwalks or scaffolding to allow human operators to access mechanical systems on the top of the clean room or to access the clean room structure itself. Conversely, a walkable-ceiling clean room system will support human beings walking upon the top of the ceiling. The non-walkable ceiling has the advantage of significantly reduced cost compared to a walkable ceiling.

Prior art non-walkable clean room ceilings are supported in a manner similar to the familiar suspended ceiling; namely, a grid of T-shaped beams hangs from the larger building structure and ceiling panels are supported at their periphery by the top of the T-shaped beams.

The prior art non-walkable clean room ceilings present disadvantages. First, the intersection of each ceiling panel and each T-shaped beam presents two raised discontinuities where biological contaminants, such as microorganisms, may find refuge and have a better chance of surviving mechanical wiping and chemical cleaners and disinfectants. Second, the bottom portion of each T-shaped beam extends below the surface of the ceiling panels and is readily visible from inside the clean room, identifying the ceiling as a less expensive and less sophisticated ceiling. Third, the ceiling panels may be raised by a person inside the clean room, disrupting any seals and jeopardizing the integrity of the clean room.

II. SUMMARY OF THE INVENTION

The invention is a mounting system for a clean room ceiling, which may be a non-walkable clean room ceiling, a clean room ceiling utilizing the mounting system and a method of installing a clean room ceiling utilizing the mounting system.

In the mounting system and clean room of the invention, a grid of inverted T-shaped beams is suspended from the structure of a larger building. Each inverted T-shaped beam includes a beam upright and opposing beam legs. The opposing beam legs in combination define the beam bottom of the inverted T-shaped beam. The beam bottom is visible as part of the installed ceiling from inside the clean room.

Each beam leg of the inverted T-shaped beam terminates in a beam joint portion. The beam joint portion extends generally in an upward direction from the beam leg and has a lower end and an upper end. The beam joint portion is relieved so that the lower end of the beam joint portion extends further from the beam upright than does the upper end of the beam joint portion. The relief of the beam joint portion is important for creating an airtight and liquid-tight clean room ceiling, as discussed below.

The ceiling includes composite panels as are known in the art. Each of the composite panels includes a top skin and a bottom skin on either side of a core. The skins provide structural strength while the core serves to separate the skins. The skins and core may be composed of any suitable material. For example, the skins may be composed of sheet steel and the core of crenelated aluminum. The skins may be composed of any other sufficiently strong sheet material, such as carbon fiber composite or fiberglass composite, and the skins may be composed of any material that is sufficiently light but strong in compression, such as balsa wood or rigid polymer foam. Any materials selected for the skins must be suitably resistant to attack by cleaning agents and disinfectants used to clean the clean room. In combination, the skins and core create a rigid ceiling panel capable of spanning the distance between opposing inverted T-shaped beams without excessive sag between the beams.

Each composite ceiling panel defines a periphery on the perimeter of the panels and between the skins. The periphery defines panel joint portions that correspond to the beam joint portions. The bottom skin may be folded upward to define the panel joint portions. Each of the panel joint portions defines a panel lower end and a panel upper end. As for the beam joint portions, the panel joint portions may be relieved between the panel joint lower end and upper end. As a result, the lower end of the panel joint portion may extend further in the horizontal direction than does the upper end of the panel joint portion.

Any configuration of the beam joint portion and the panel joint portion that provides relief between the panel joint upper end and the beam joint upper end is contemplated by the invention. For example, the angle between the panel joint portion and the bottom skin may be 90 degrees and the corresponding angle between the beam joint portion and the beam bottom may be less than 90 degrees. As a second example, the angle between the panel joint portion and the bottom skin may be less than 90 degrees and the corresponding angle between the beam joint portion and the beam bottom may be 90 degrees. Both examples provide the needed relief. So long as the sum of the angles between the panel joint portion and the bottom skin and the corresponding angle between the beam joint portion and the beam bottom is less than 180 degrees, the needed relief is provided.

During installation, the panel joint portion is held in engagement with the beam joint portion by a bracket. The bracket includes a bracket horizontal portion that is attached to the panel top skin by an installer. The installer may attach the bracket horizontal portion to the top skin using any suitable mechanism, such as sheet metal screws, adhesive, or other fastener. The bracket also includes a bracket hook portion that depends from the bracket horizontal portion and that connects the beam joint portion to the panel joint portion. When the panel joint portion is in engagement with the beam joint portion in the installed ceiling or during installation, the lower end of the beam joint portion touches the lower end of the panel joint portion. Because of the relief discussed above, the upper end of the beam joint portion does not touch the upper end of the panel joint portion.

Because of the relief of the beam and panel joint portions, the inverted T-shaped beam and the panel engage each other immediately adjacent to the bottom skin and immediately adjacent to the bottom side of the inverted T-shaped beam, and not in any other location. All that is visible of the joint from inside the clean room is a shallow groove. Because the inverted T-shaped beam and panel engage one another only at the bottom edge of both structures, there are no cracks or deep grooves at the joint in which microorganisms or other contaminants can avoid cleaning and disinfection.

Because of the close engagement of the panel and inverted T-shaped beam only at the bottom edge of both structures, no gaskets, caulks or fillers are required. Solvent welding, as described in the following paragraph, is adequate to fully seal the joint between the inverted T-shaped beam and the panel and render the joint gas- and liquid-tight.

To seal the joint between the inverted T-shaped beam and the panel so that the junction is liquid and gas-tight, the bottom side of the inverted T-shaped beam and the panel bottom skin are coated prior to installation with polyvinyl chloride ('PVC') or with another polymer that will resist moisture and chemical attack but that will dissolve in a solvent and is solvent-weldable. After the inverted T-shaped beam and the panel are installed, the installer will apply a small amount of the solvent to the joint. The solvent will dissolve the PVC or other polymer coating the bottom side of the inverted T-shaped beam and the PVC or other solvent coating the bottom skin. The mixture of solvent and dissolved polymer will then flow into the joint. When the solvent evaporates, the PVC or other polymer forms a continuous coating on the bottom side of the inverted T-shaped beam, into the joint, and over the panel bottom skin.

The inverted T-shaped beam may be composed of any suitable material, such as an aluminum extrusion or a polymer. The inverted T-shaped beam may comprise a beam frame and a beam wrap. The beam frame defines the beam upright and the two opposing legs of the inverted T-shaped beam. The beam frame also defines two opposing beam frame standards on opposing ends of the two legs.

The beam wrap clads the lower side of the beam legs and the beam standards in a layer of sheet steel. The beam wrap comprises a beam wrap bottom and two opposing beam wrap sides. The beam wrap sides grip the beam frame standards to hold the beam wrap to the beam frame. The beam wrap sides and the beam standards in cooperation define the beam joint portions and define the beam joint lower end and upper end.

The beam wrap sides may grip the beam frame standards resiliently by spring action. Alternatively, the beam wrap sides may define hook portions to engage the ends of the beam frame standards and to keep the beam wrap in engagement with the beam frame.

A spring clip may resiliently engage the beam upright. The beam upright may be equipped with opposing bosses for the spring clip to engage and to prevent unintentional release of the spring clip. The spring clip may include one or more arms that bear upon the bracket or upon the top skin of the composite ceiling panel when the spring clip engages the beam upright. The purpose of the spring clip is to resist upward motion of the composite ceiling panel with respect to the inverted T-shaped beam, as by a person pushing up on the composite ceiling panel from below. If a person were to successfully raise the composite ceiling panel, the seal between the ceiling panel and the inverted T-shaped beam would be damaged and the integrity of the clean room disrupted.

In the method of the invention, an installer will attach the inverted T-shaped beam to the interior of the building structure, as by hanging the inverted T-shaped beam from wires as part of a grid pattern. The installer will attach brackets to the top skin of the ceiling panel and will place the brackets in engagement with the beam joint portion of the inverted T-shaped beams. The inverted T-shaped beams will then support the ceiling panel so that the bottom skin of the ceiling panel is flush and coplanar with the beam bottom.

The installer will insert one or more spring clips over the beam upright. The spring clips are retained on the beam upright by spring clamping force. Opposing bosses may be provided on the beam upright to assist the clamping of the spring clip to grip the beam upright.

The bottom skin of the ceiling panel, the beam bottom, the panel joint lower end and the beam joint lower end all have a polymer coating, such as polyvinyl chloride. The installer will apply solvent to the joint. The solvent will dissolve the polymer on both sides of the joint and the solvent and polymer will flow into the joint. The solvent will evaporate, re-adhering the polymer to both sides of the joint and within the joint. The joint is now liquid-tight and gas-tight. The clean room ceiling is complete and ready for use.

III. SUMMARY OF THE DRAWINGS

IV. DESCRIPTION OF AN EMBODIMENT

The invention is a clean room ceiling system, a clean room ceiling 2 constructed using the system of the invention, and a method of constructing a clean room ceiling 2.

Figure 1:
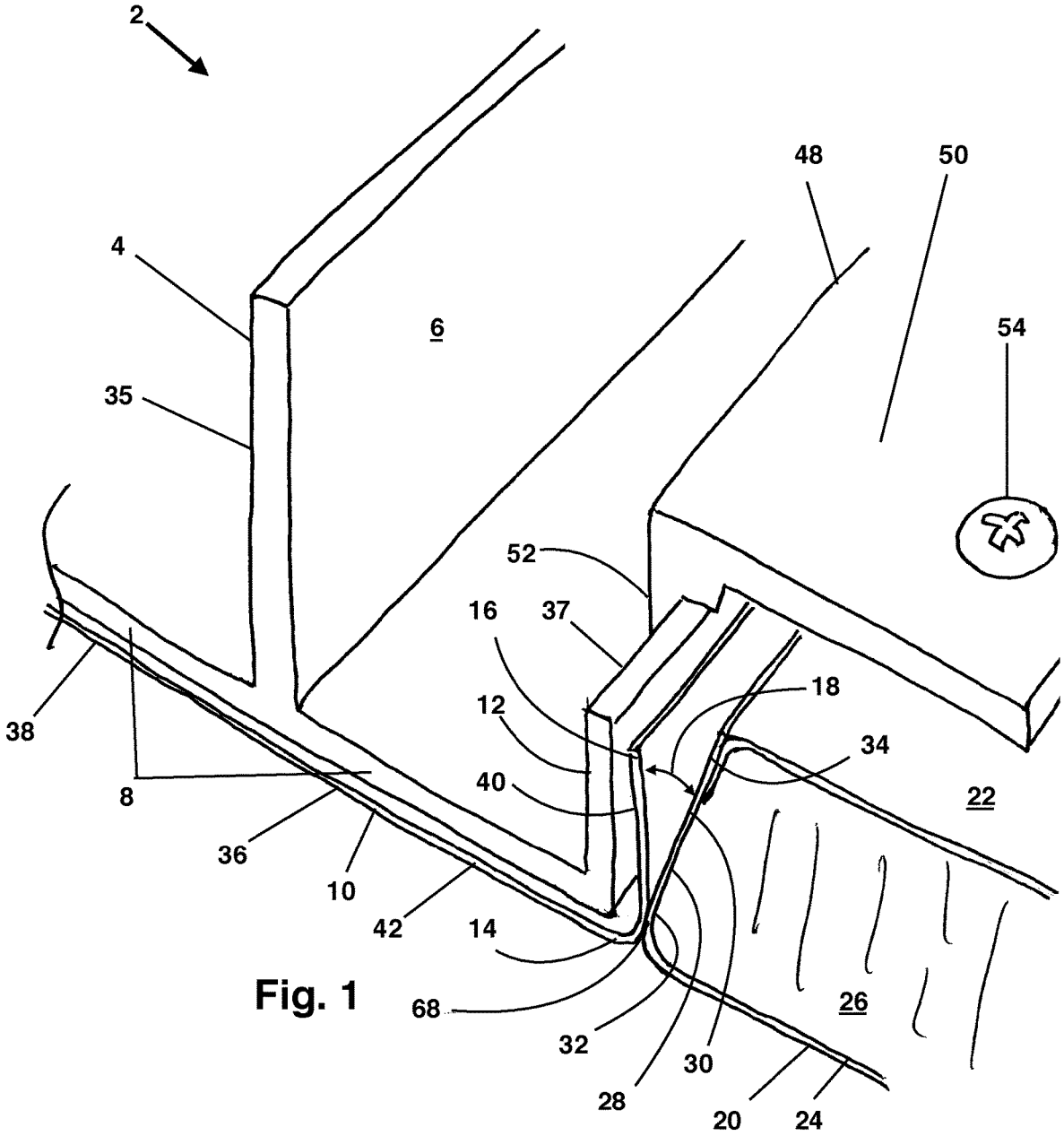
FIG. 1 is a detail perspective view of the clean room ceiling.
Figure 2:
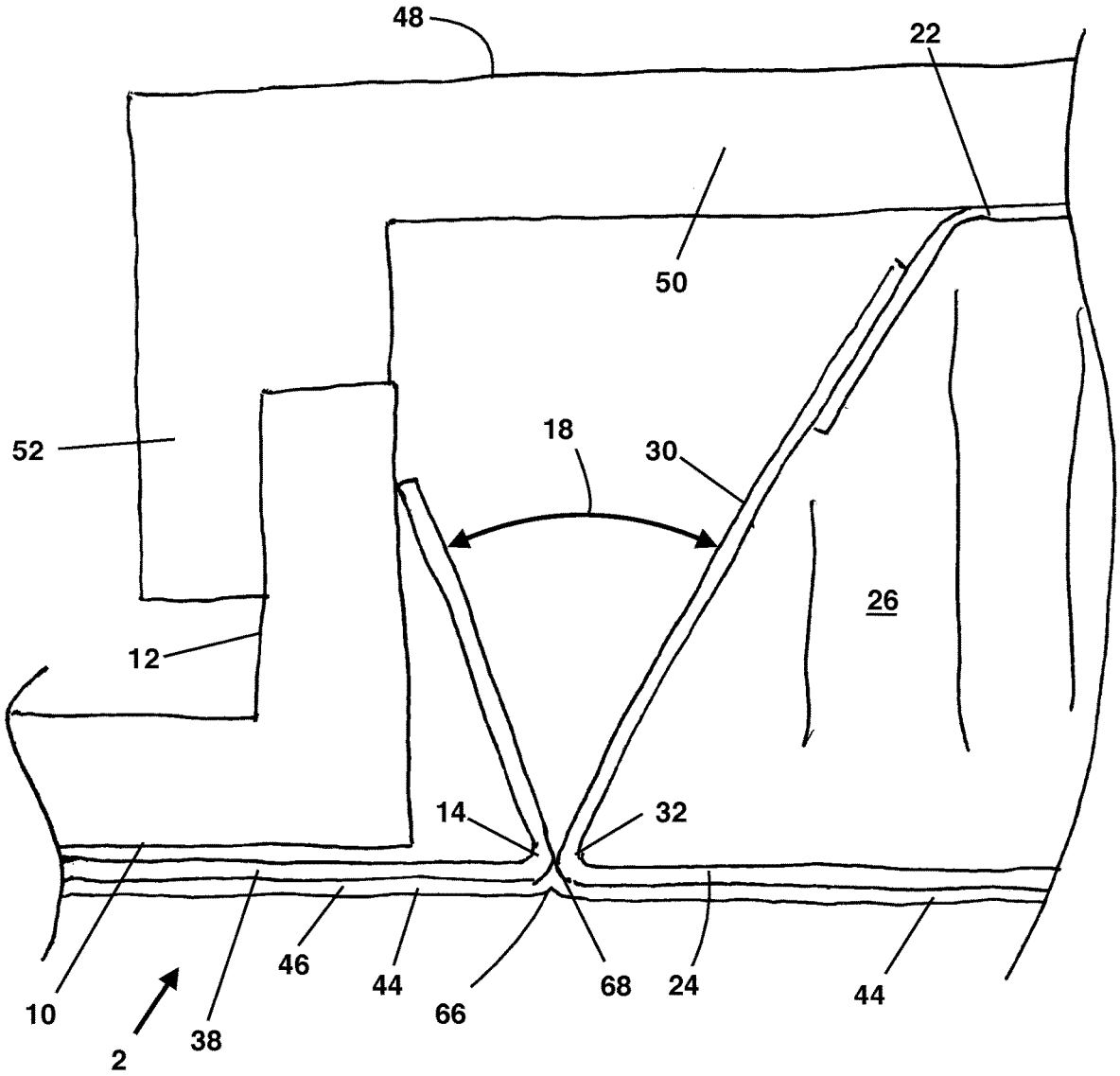
FIG. 2 is detail end view of the clean room ceiling.

FIG. 1 is a detail perspective view of a clean room ceiling 2 of the Invention. FIG. 2 is a detail side view of the clean room ceiling 2. An inverted T-shaped beam 4 is suspended from a building structure in a grid pattern in the same manner as a familiar drop ceiling. The inverted T-shaped beam 4 includes a beam upright 6 and two opposing beam legs 8. The two opposing beam legs 8 define the beam bottom 10. Each of the opposing beam legs 8 defines a beam joint portion 12 that extends generally in an upward direction from the corresponding beam leg 10. The beam joint portion 12 defines a beam joint portion lower end 14 and a beam joint portion upper end 16.

A composite ceiling panel 20 comprises a top skin 22, a bottom skin 24 and a core 26. The top and bottom skin 22, 24 may be composed of sheet steel and the core 26 may be composed of crenelated aluminum. Any other adequately strong materials may be used for the skins 22, 24 and core 26. The composite ceiling panel 20 is a stiff and because of its composite construction may span a distance of several feet without unacceptable sagging. The composite ceiling panel 20 also defines a periphery 28. The periphery 28 defines a panel joint portion 30, which is configured to engage the corresponding beam joint portion 12 so that the bottom skin 24 and the beam bottom are coplanar. The panel joint portion 30 defines a panel joint lower end 32 and a panel joint upper end 34.

Also from FIGS. 1 and 2, when the panel joint portion 30 and the beam joint portion 12 are in engagement, panel joint portion 30 and beam joint portion 12 in cooperation define a relief 18. Because of the relief 18, the panel joint upper end 34 and the beam joint portion upper end 16 are not in engagement when the panel joint lower end 32 and the beam joint portion lower end 14 are in engagement. In FIGS. 1 and 2 the amount of the relief 18 is exaggerated for purposes of illustration. The relief 18 may be any that allows the panel joint lower end 32 and the beam joint lower end 14 to be in contact but that provides that the panel joint upper end 34 and the beam joint upper end 16 are not in contact when the beam bottom 10 and the bottom skin 24 are flush and disposed on the same plane.

The beam 4 optionally may be composed of a beam frame 35 cooperating with a beam wrap 36, as shown by FIGS. 1 and 2 and as shown in more detail on FIGS. 3 through 10. The beam frame 35 defines the beam upright 6 and opposing beam legs 8. The beam frame 35 also defines beam standards 37 extending from the beam legs 8. The beam wrap 36 comprises a beam wrap bottom 38 and opposing beam wrap sides 40. The beam wrap bottom 38 defines the beam bottom 10. The beam wrap sides 40 in cooperation with the beam standards 37 define the beam joint portions 12, the beam joint lower end 14 and the beam joint upper end 16.

Alternatively, the inverted T-shaped beam 4 may dispense with the beam wrap 36 and the beam standard 37 may define the beam joint upper end 16 and beam joint lower end 14.

When provided, the beam wrap 36 may be composed of sheet steel. The beam wrap bottom 38 of the completed clean room ceiling 2 is visible from inside the clean room.

The opposing beam joint portions 12 may define angles of less than 90 degrees with the beam bottom 10 and may define the relief 18, as shown by FIGS. 1 and 2.

The beam wrap bottom 38 and two opposing sides 40 may define a beam wrap spring 42 in the shape of a shallow 'U.' The beam wrap spring 42 may resiliently grip the opposing beam standards 37 to retain the beam wrap 36 in engagement with the beam frame 35.

A polymer coating 44 is disposed on the beam bottom 10, the beam joint lower end 14 and the panel joint lower end 32. The polymer 46 is selected to be solvent weldable. A suitable solvent-weldable polymer is polyvinyl chloride. A polymer 46 is solvent weldable where the solvent will dissolve the polymer coating 44 and evaporation of the solvent re-adhere the polymer 46 to the coated surface and flows into the joint 68 between the inverted T-shaped beam 4 and the ceiling panel 20 to form a gas-tight and liquid-tight seal.

From FIGS. 1 and 2, the composite ceiling panel 20 is supported by a bracket 48. The bracket 48 has a horizontal portion 50 and a bracket hook portion 52 that depends from the horizontal portion 50. The horizontal portion is configured to engage the top skin 22 of the composite ceiling panel 20, as by fasteners 54. The fasteners 54 hold the bracket 48 to the composite ceiling panel 20. The beam joint portion 12 supports the bracket 48, and hence the composite ceiling panel 20. The inverted T-shaped beam 4 thus supports the composite ceiling panel 20. The bracket 48 supports the ceiling panel 20 so that the bottom skin 24 of the ceiling panel 20 is flush and coplanar with the beam bottom 10.

Figures 3, 4:
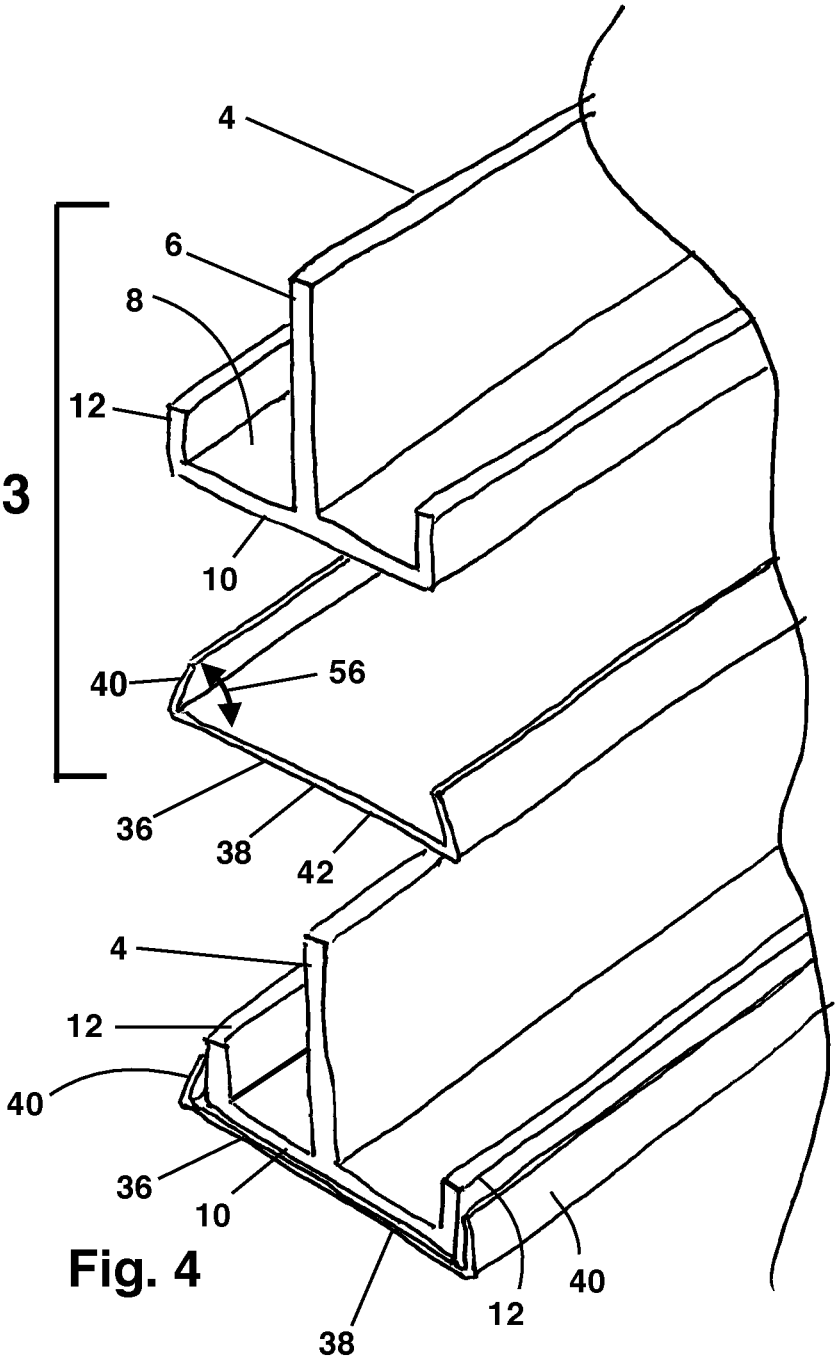
FIG. 3 is a perspective exploded view of the beam frame and the beam wrap.
FIG. 4 is a detail perspective view of the inverted T-shaped beam.
Figure 5:
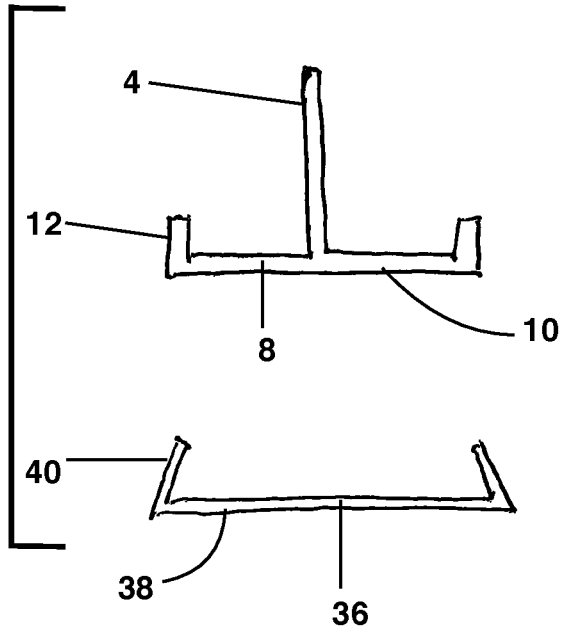
FIG. 5 is an exploded end view of the beam frame and beam wrap corresponding to FIG. 3.
Figure 6:
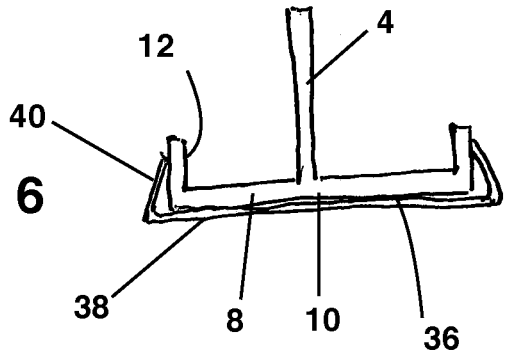
FIG. 6 is an end view of the inverted T-shaped beam corresponding to FIG. 4.

FIG. 3 is a perspective exploded view of the beam frame 35 and the beam wrap 36, shown in end view by FIG. 5. FIG. 4 is a perspective view of the beam wrap 36 engaging the beam frame 35, shown in end view by FIG. 6. Beam wrap side 40 and beam wrap standard 37 together define the beam joint portion 12, which defines an angle 56 of less than 90 degrees with respect to the beam bottom 10.

Together the beam wrap base 38 and beam wrap sides 40 define a beam wrap spring 42 in the shape of a shallow 'U.' FIG. 4 shows the beam wrap 36 in engagement with the beam frame 35, with the beam wrap 46, as the beam wrap spring 42, resiliently clamping the opposing beam standards 37 between the two sides 40.

Figures 7, 8:
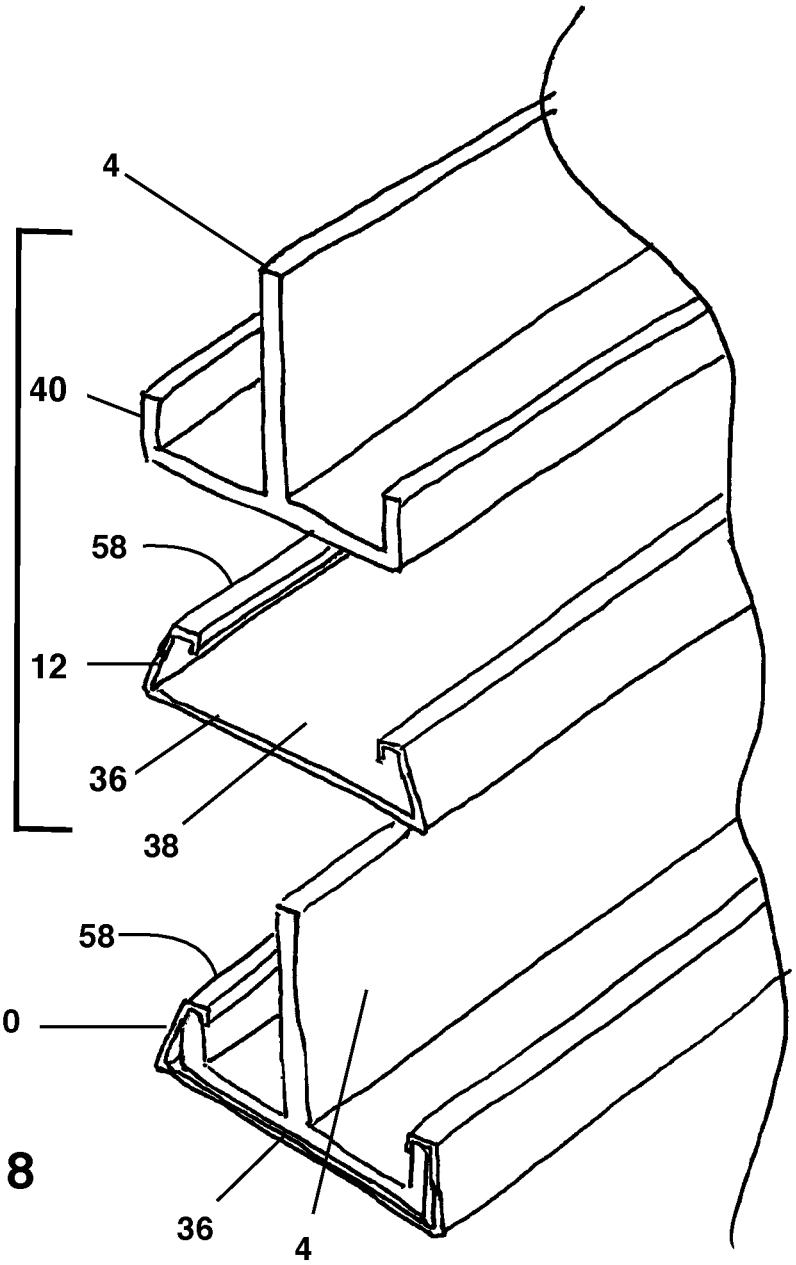
FIG. 7 is a perspective exploded view of the beam frame and beam wrap having hook ends.
FIG. 8 is perspective of the inverted T-shaped beam.
Figure 9:
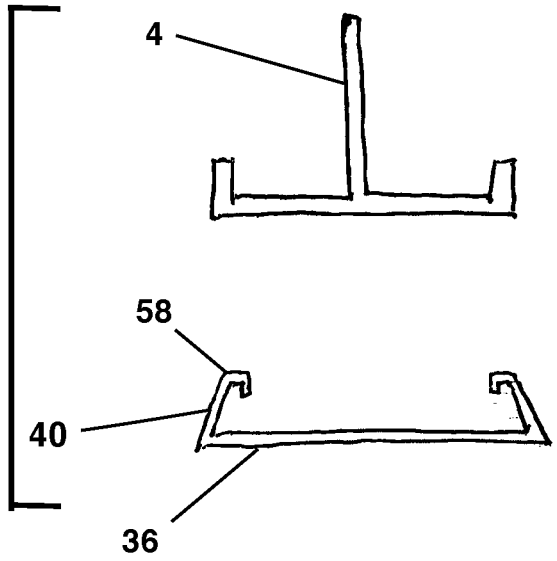
FIG. 9 is an end view corresponding to FIG. 7.
Figure 10:
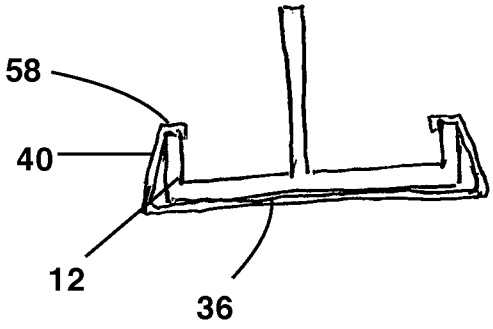
FIG. 10 is an end view corresponding to FIG. 8.

FIG. 7 is a perspective exploded view of beam frame 35 and beam wrap 36. FIG. 9 is the corresponding end view. FIG. 8 is a perspective view of the joined beam frame 35 and beam wrap 36. FIG. 10 is the corresponding end view. In the example of FIGS. 7 through 10, the beam wrap 36 include beam wrap hooks 58 disposed on the beam wrap ends 40 and configured to engage an end of the beam frame standard 37. Beam wrap hooks 58 positively secure the beam wrap 36 to the beam frame 37 and prevent the beam wrap 58 from being pulled away from the beam frame 37. The beam wrap 36 of FIGS. 7 through 10 otherwise is similar to the beam wrap 36 of FIGS. 3-9.

Figure 11:
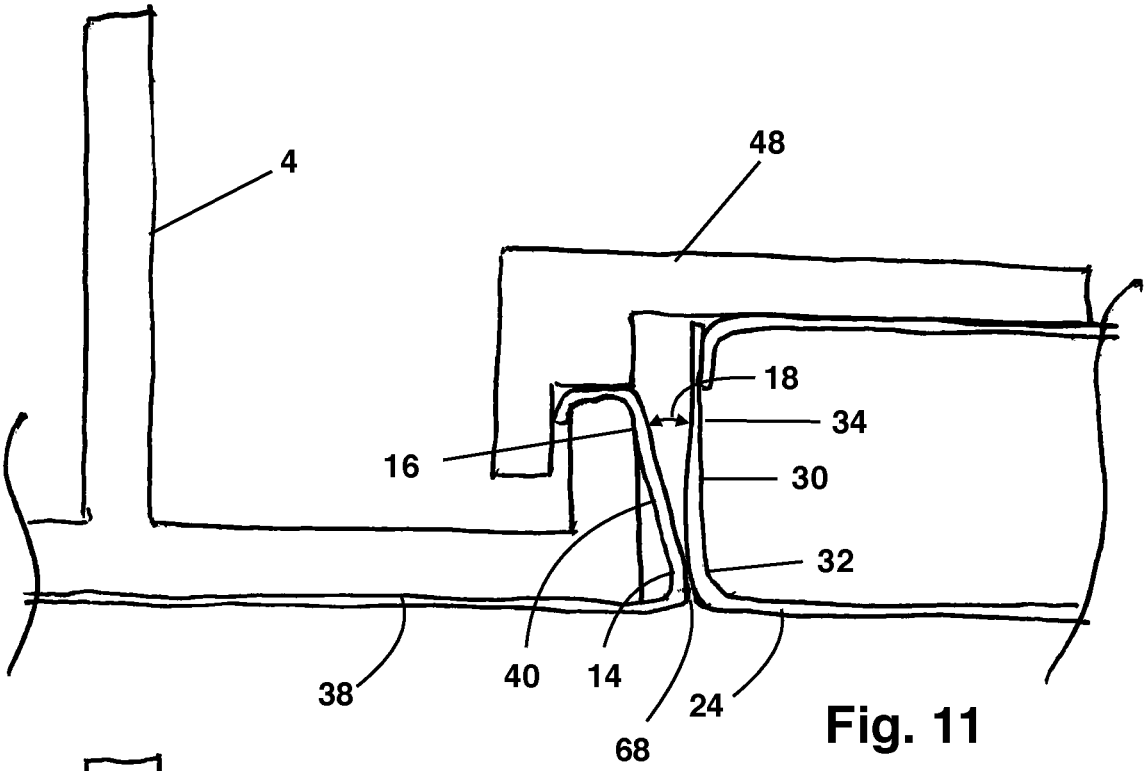
FIG. 11 is a side view showing an alternate configuration of the panel joint portion.
Figure 12:
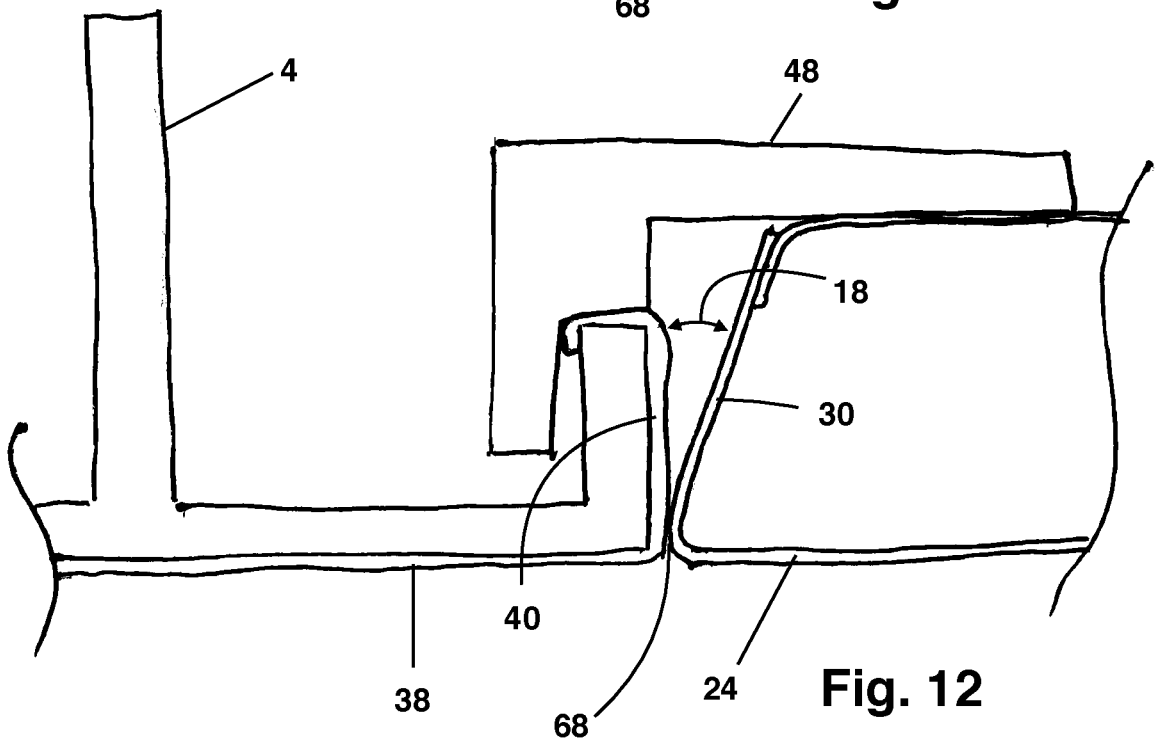
FIG. 12 is a side view showing an alternate configuration of the beam joint portion.

FIGS. 11 and 12 illustrate two alternative configurations of the clean room ceiling 2 to achieve the required relief 18. In FIG. 11, the angle between the panel joint portion 30 and the bottom skin 24 is 90 degrees or more while the angle between the beam joint portion 12 and the beam bottom 10 is less than 90 degrees. The resulting gap defines the relief 18.

In FIG. 12 the angle between the panel joint portion 30 and the bottom skin is less than 90 degrees while the angle between the beam bottom 10 and the beam joint portion 10 is 90 degrees or more. The result is relief 18.

In sum, any arrangement of the panel joint portion 30 and the beam joint portion 12 that results in a relief 18 between the beam joint upper end 16 and the panel joint upper end 34 when the beam joint lower end 14 and the panel joint lower end 32 are in engagement is contemplated by the Invention.

Figure 13:
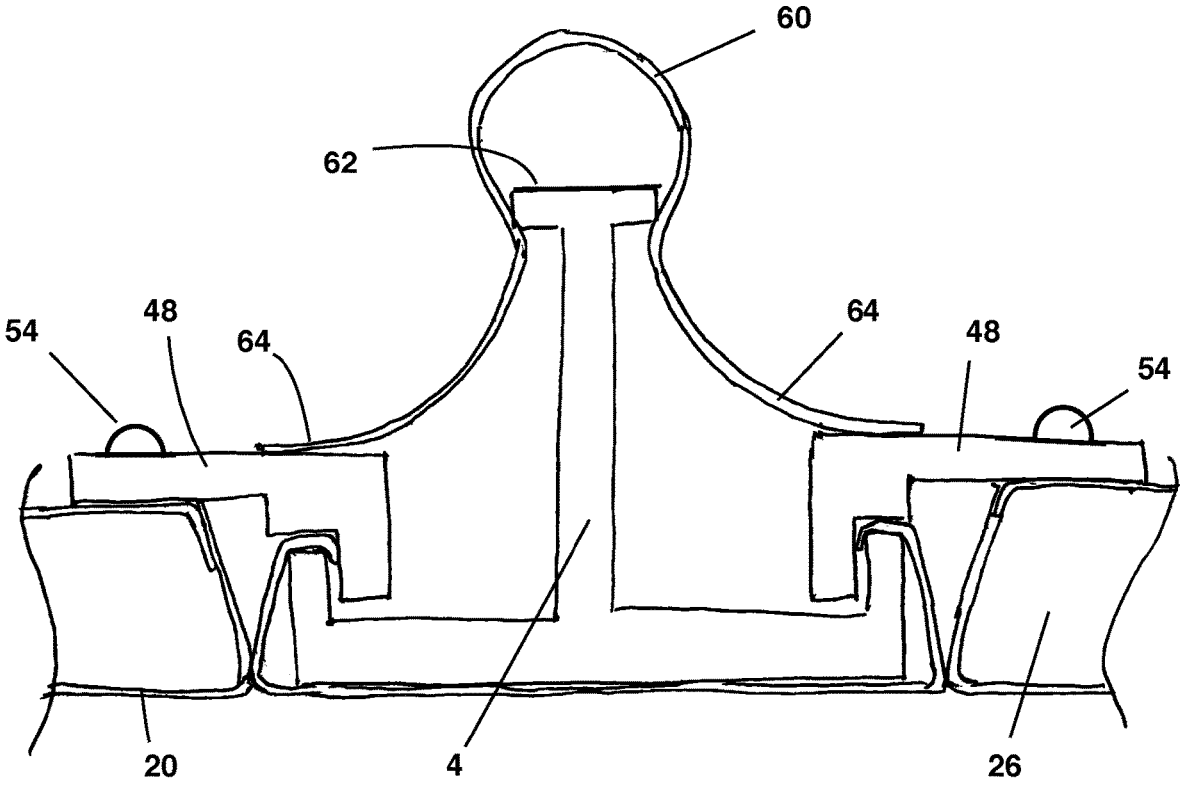
FIG. 13 is a side view showing a spring clip.

FIG. 13 is an end view of an installed spring clip 60 to resist a composite ceiling panel 20 from being dislodged from a completed clean room ceiling 2 by pushing up on the ceiling panel 20 from below. The spring clip 60 is composed of a suitably strong and resilient material, such as steel. The spring clip 60 resiliently engages a pair of bosses 62 on opposing sides of the beam upright 6. The bosses retain the spring clip 60 on the beam upright 6. The spring clip also defines opposing arms 64. The arms 64 bear upon the bracket 48 or on the top skin 22 when the spring clip 60 engages the bosses 62. The arms 64 resiliently resist movement of the composite ceiling panel 20 in the upward direction with respect to the inverted T-shaped beam 4.

Figure 14:
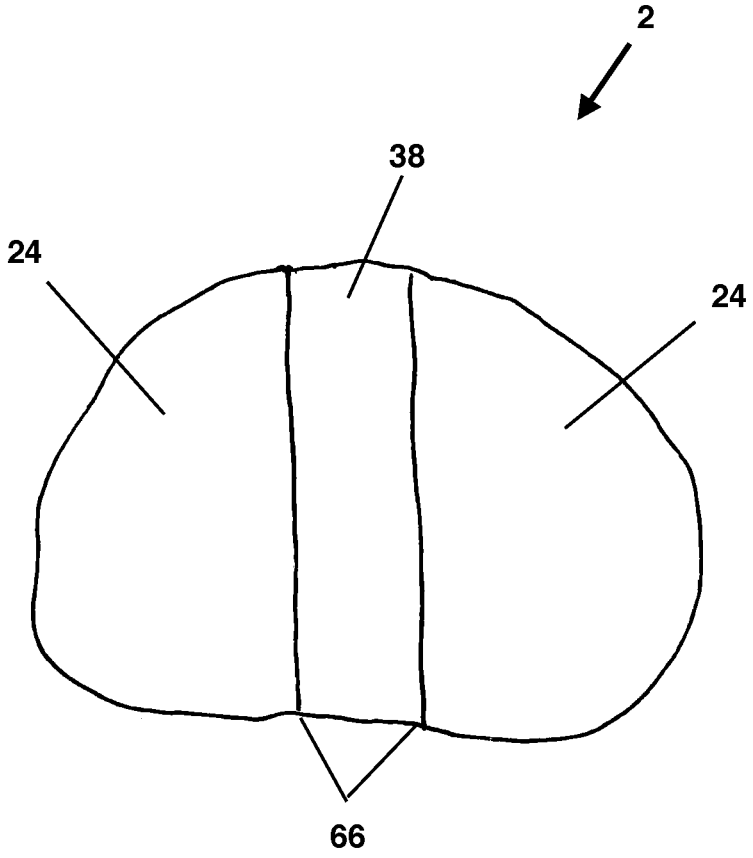
FIG. 14 is a detail view of a portion of the clean room ceiling from inside the clean room.

FIG. 14 is a view of the completed clean room ceiling 2 from the inside of the clean room. The person observing the clean room ceiling 2 will see a smooth, flat surface defined by the bottom skins 24 and by the beam wrap bottom side 38. The bottom skins 24 are separated from the beam wrap bottom side 38 by a pair of narrow, shallow grooves 66. The grooves 66 are the joints 68 between the panel joint lower ends 32 and the beam joint lower end 14. The grooves 66 are sealed by solvent welding the polymer coating on the bottom skins 24 and the beam bottom 10. After assembly, solvent is applied to the joint 68. The solvent 46 dissolves the polymer 46 and carries the polymer 46 into the joint 68. The solvent 46 evaporates, depositing the polymer 46 within the joint 68 and onto the bottom skin 24 and beam bottom 10. The polymer 46-coated surfaces and sealed joint 68 are illustrated by FIG. 2.

Unless the context requires otherwise, any description of a feature with respect to any drawing applies equally to that feature or to corresponding features on other drawings.

The following is a list of numbered elements from the claims and specification.

a clean room ceiling 2
an inverted T-shaped beam 4
a beam upright 6
opposing beam legs 8
beam bottom 10
a beam joint portion 12
a beam joint lower end 14
an beam joint upper end 16
a relief 18
a composite ceiling panel 20
a top skin 22
a bottom skin 24
a core 26
periphery 28
panel joint portions 30
panel joint lower end 32
panel joint upper end 34
beam frame 35
beam wrap 36
beam standards 37
beam wrap bottom 38
beam wrap side 40
an angle of less than 90 degrees
beam wrap spring 42
a polymer coating 44
a polymer 46
a bracket 48
a bracket horizontal portion 50
a bracket hook portion 52
fasteners 54
an angle of less than 90 degrees 56
beam wrap hook 58
a spring clip 60
a pair of bosses 62
a spring clip arm 64
a shallow groove 66
joint 68

We claim:

1. A clean room ceiling system for use inside a building structure, the system comprising:

a) an inverted T-shaped beam, the inverted T-shaped beam defining a beam upright, the beam upright being configured to be supported by the building structure, the inverted T-shaped beam defining opposing beam legs, the opposing beam legs extending laterally from the beam upright and defining a beam bottom, each beam leg terminating in a beam joint portion, each beam joint portion extending generally in an upward direction from each beam leg, each beam joint portion defining a beam joint upper end and a beam joint lower end;

b) a composite ceiling panel, the composite ceiling panel having a top skin, a bottom skin and a core disposed between the top and bottom skins, the composite ceiling panel defining a periphery, the periphery of the composite ceiling panel defining a panel joint portion, the panel joint portion defining a panel joint lower end and a panel joint upper end, the panel joint portion being configured for an engagement with the beam joint portion, wherein the panel joint portion and the beam joint portion define a relief when the panel joint portion and the beam joint portion are in engagement so that the beam joint lower end engages the panel joint lower end and the beam joint upper end does not engage the panel joint upper end.

2. The clean room ceiling system of claim 1, the system further comprising: a polymer coating, the polymer coating being disposed on the beam bottom, the bottom skin, the beam joint lower end and the panel joint lower end, the polymer coating being weldable by a solvent applied to the beam joint lower end and the panel joint lower end when the beam joint portion lower and the panel joint lower end are in engagement.

3. The clean room ceiling system of claim 2 wherein the polymer coating is polyvinyl chloride.

4. The clean room ceiling system of claim 2 wherein the inverted T-shaped beam comprises:

a) a beam frame, the beam frame defining the beam upright, the opposing beam legs and a pair of opposing frame standards extending from the opposing beam legs;

b. a beam wrap disposed on the beam frame, the beam wrap defining the beam bottom and a pair of opposing beam wrap sides, the beam wrap sides engaging the opposing frame standards to define the beam joint portions, each beam joint portion defining an angle of less than 90 degrees to the beam bottom, the beam joint portion defining the relief between the beam joint portion and the panel joint portion when the beam joint portion and the panel joint portion are in engagement.

5. The clean room ceiling system of claim 4 wherein the beam wrap sides and beam wrap bottom in combination define a beam wrap spring in the shape of a shallow U, the opposing beam wrap sides being configured to resiliently grip the frame standards and to be retained by the beam frame.

6. The clean room ceiling of claim 4 wherein the beam frame is composed of a polymer.

7. The clean room ceiling system of claim 2 wherein the inverted T-shaped beam comprises:

a) a beam frame, the beam frame defining the beam upright, the opposing beam legs and a pair of opposing frame standards extending from the opposing beam legs;

b. a beam wrap disposed on the beam frame, the beam wrap defining the beam bottom and a beam wrap side, the beam wrap sides engaging the opposing frame standards to define the beam joint portions;

c. a pair of opposing beam wrap hooks, the beam wrap hooks being defined by the beam wrap sides and each of the beam wrap hooks engaging an end of the frame standard.

8. The clean room ceiling system of claim 7 wherein the beam joint portion defines an angle of less than 90 degrees to the beam bottom.

9. The clean room ceiling of claim 7 wherein the beam frame is composed of a polymer.

10. The clean room ceiling system of claim 2 wherein the beam joint portion defines an angle of less than 90 degrees with respect to the beam bottom.

11. The clean room ceiling system of claim 10 wherein the panel joint portion defines an angle of less than 90 degrees with respect to the bottom skin.

12. The clean room ceiling system of claim 2 wherein the panel joint portion defines an angle of less than 90 degrees with respect to the bottom skin.

13. The clean room ceiling system of claim 1, the system further comprising: a bracket, the bracket defining a bracket horizontal portion and a bracket hook portion, the bracket hook portion depending from the bracket horizontal portion, the bracket horizontal portion being configured to be attached to the top skin so that the ceiling panel is supported by the bracket, the bracket hook portion being configured to engage the beam joint portion so that the beam joint portion supports the bracket and the attached ceiling panel with the bottom skin flush with the beam bottom.

14. The clean room ceiling system of claim 13 further comprising: a spring clip, the spring clip being configured to resiliently engage the beam upright and to be selectably retained by the beam upright, the spring clip defining a spring clip arm, the arm being configured to selectably engage the bracket when the bracket horizontal portion is attached to the panel top side and the bracket hook portion engages the beam joint portion, the spring clip arm being configured to resiliently urge the bracket hook portion to remain in engagement with the beam joint portion.

15. The clean room ceiling system of claim 14, the system further comprising: a pair of bosses disposed on opposing sides of the beam upright, the spring clip being configured to resiliently engage and to be selectably retained by the pair of bosses.

16. The clean room ceiling of claim 13 wherein the beam wrap, the panel top skin and the panel bottom skin are composed of a sheet steel.

* * * * *